US005845463A

United States Patent [19]

Henaux

[11] Patent Number: 5,845,463

[45] Date of Patent: Dec. 8, 1998

[54] PROCESS AND DEVICE FOR FORMING MULTI-COMPARTMENT BAGS AND SACHETS THUS OBTAINED

[76] Inventor: Claude Henri Henaux, 14, Rue Antoine Bourdelle, 75015 Paris, France

[21] Appl. No.: 861,777

[22] Filed: May 22, 1997

[51] Int. Cl.[6] ..... B65B 9/00

[52] U.S. Cl. ..... 53/450; 53/455; 53/474; 53/550

[58] Field of Search ..... 53/455, 450, 468, 53/550, 474, 384.1, 385.1, 386.1

[56] References Cited

U.S. PATENT DOCUMENTS

| | | | |
|---|---|---|---|
| 3,739,522 | 6/1973 | Greenbaum | 53/455 |
| 4,201,031 | 5/1980 | Wiles | 53/455 |
| 4,216,639 | 8/1980 | Gautier | 53/455 |
| 4,344,269 | 8/1982 | Dieterlen | 53/455 |
| 4,594,835 | 6/1986 | Gray | 53/474 |
| 4,656,042 | 4/1987 | Risler | 53/474 |
| 5,210,993 | 5/1993 | Van Boxtel | 53/455 |
| 5,337,539 | 8/1994 | Barton | 53/455 |
| 5,507,132 | 4/1996 | Gwiarzdon et al. | 53/386.1 |

FOREIGN PATENT DOCUMENTS

| | | |
|---|---|---|
| 2640231 | 12/1988 | France . |
| 2682932 | 10/1991 | France . |
| 308165 | 9/1955 | Germany . |
| 1901109 | 9/1969 | Germany . |

*Primary Examiner*—James F. Coan
*Assistant Examiner*—Gene L. Kim
*Attorney, Agent, or Firm*—Ladas & Parry

[57] ABSTRACT

The technical sector of the invention is that of the domain of bag-forming by packaging such as bags and especially sachets, made from flat webs folded and sealed to form bags which are then filled with liquid, pasty or pulverulent product, and closed. A bag-forming line according to the process of the present invention comprises a device for opening a sachet of rectangular shape made by two walls of supple material fast on three sides and constituting at least one bag, such that it comprises at least two suction cups disposed opposite so that they may be placed against each wall of said sachet and adapted to draw thereon, in order to open the walls at the level of the fourth side not fast with said bag; it comprises at least two pairs of said suction cups mounted at the end of arms mobile with respect to fixed guides and forming, between those disposed on the same side and dis-placeable simultaneously, a divergent angle whose aperture is oriented opposite that of the same aperture formed by the arms disposed on the other side.

11 Claims, 4 Drawing Sheets

PROCESS AND DEVICE FOR FORMING MULTI-COMPARTMENT BAGS AND SACHETS THUS OBTAINED

FIELD OF THE INVENTION

The present invention relates to a process and device for forming multiple bags and to sachets thus obtained, also called multi-compartment bags.

The technical sector of the invention is that of the domain of bag-forming by packaging, such as bags and especially sachets, made by flat webs folded and sealed to form bags which are then filled with liquid, pasty or pulverulent product, and closed.

One of the principal applications of the invention is the possibility of making multi-bag sachets presenting at least three compartments which may each receive a different product, pulverulent or other, such as for example sugar, coffee and powdered milk, thus constituting a complete assembly for preparing breakfast, which makes it possible to simplify the handling and preparation of trays, for example in communities.

BACKGROUND OF THE INVENTION

Different automatized bag-forming lines are in fact known, which make sachets containing a predetermined dose of a liquid, pulverulent or pasty product, which is injected or caused to flow by gravity and/or by any dosing device in each bag constituted and then closed to be distributed either individually or in a continuous strip of sachets. However, up to the present time, such bag-forming lines have been developed essentially for doses or sachets containing the same product, the outer surface of the web which is folded and welded, or of the welded webs, to constitute said sachets, being pre-printed with the legend corresponding to the products having to be packaged, such as in the process and device described in French Patent Application 2 640 231 published or Jun. 15, 1990 and entitled: "Process and device for manufacturing and presenting samples in the form of doses".

Such machines are known not only in the agri-business, but also in the domain of pharmaceutical or beauty products.

However, up to the present time, no device has been able to produce, reliably, rapidly and efficiently, multi-bag sachets which it is desired to fill simultaneously with at least two different products, by simple gravity and/or any type of doser but without injection nozzle.

French Patent Application 2 682 932, published on Apr. 20, 1993 and entitled "Process for producing sachet-dose packs, machine for carrying it out as well as the packs obtained" is indeed known, disclosing-containing different products but with injection of the products by nozzles and in a device which can only be along a vertical axis of advance from two webs of sheets whose width corresponds to that of the packs, or to the sum of that of all the bags, which limits the possibilities thereof.

The problem raised in order to be able to attain the above object of multi-bag sachets which may be filled with several different products, is that of being able to present the various compartments of the same sachet beneath the orifices for filling said products after having sufficiently opened the volume of each of the bags by moving apart the walls which are made of supple and deformable material but which, due to the welds in particular and a certain inherent rigidity, cannot be sufficiently deformed under the simple weight of the product which is deposited or which is poured, to receive the whole volume of the desired dose; it is therefor necessary previously to move apart the walls of each bag to the maximum of volume so that filling can be effected under good conditions. Up to the present time, for single-bag or single-product sachets, it is known, in addition to the process of packaging as described hereinafter for preparing said bags, to open them by pairs of suction cups disposed near the opening of each bag in order to draw by suction the corresponding walls for each bag taken one after the other then to dispose the latter beneath the opening for filling one and the same product: the bags are in that case all identical.

In the case of multi-compartment sachets, as all the bags of the same sachet hold together with respect to one another and, during opening of the walls, the latter deform, the dimensions of each bag are in that case not constant and no device, at the present time, ensures simultaneous and sufficient opening of at least two bags, if not, of course, three.

SUMMARY OF THE INVENTION

One solution to the problem raised is a device for opening a sachet of rectangular shape made by two walls of supple material fast on three sides and constituting at least one bag, such that it comprises in known manner at least two suction cups disposed face to face so that they can be placed against each wall of said sachet and adapted to pull thereon, in ordre to open the walls at the level of the fourth side not fast with said bag; according to the invention, the opening device comprises at least two pairs, viz. in fact as many as there are fast bags having to constitute an independent sachet, of said suction cups mounted at the end of arms mobile with respect to fixed guides and forming, between those disposed on the same side and movable simultaneously, a divergent angle whose aperture $\alpha$ is oriented opposite that of the same aperture $\alpha$ formed by the arms disposed on the other side and bearing the suction cups which are opposite theirs'.

In order to facilitate said opening of each bag, in a preferred embodiment, the device comprises at least two, in fact as many as there are bags fast with the same sachet nozzles blowing gas, such as compressed air, oriented in the plane defined by said suction cups connected face to face and each towards the point of contact thereof; this makes it possible to assist separation of the walls not only to ensure opening of each bag, but also to inflate the latter and obtain deformation of the desired volume.

When the height of the sachet is great, suction of the walls close to the opening, even with the aid of a blowing nozzle, is not sufficient to deform the whole of the volume of each bag; in a preferred embodiment, for such sachets, the device according to the invention thus comprises two assemblies of pairs of suction cups disposed and mobile in parallel planes, each suction cup of the pairs of the second assembly being in the same plane, perpendicular to said parallel planes of mobility, as the suction cup of the pair of the first assembly which is associated therewith for the same bag.

By using a continuous bag-forming line or machine preferably disposed along a horizontal axis of displacement, comprising different work stations, a step-by-step drive system and a device as described hereinabove, the bag-forming process according to the invention consists in:

- forming a web of constant and continuous width of a supple material with double walls fast with each other by one of their continuous edges;
- sealing the two walls together perpendicularly to said edge over a zone of sufficient width to be divided into two while keeping on each side of the cut the walls sealed at given intervals to produce bags, whose bottom is in that case constituted by said continuous edge of the web;

cutting out said web along said seals defining bags to obtain sachets independent of one another, viz. at least every two bags and preferably three, to constitute independent multi-bag sachets;

opening the free edges of each bag located on the side opposite said bottom by at least two suction cups each pulling one of said walls; to that end, at least as many pairs, viz. therefore at least two and preferably three, or even more depending on the case, of suction cups are disposed on either side of said web as there are bags constituting each independent sachet, which suction cups are mounted at the end of arms mobile with respect to fixed guides and forming a divergent angle therebetween, of which the aperture $\alpha$ is oriented opposite the plane defines by said web, which arms are fast with supports which, when they are moved apart to open the openings of said bags of the same sachet simultaneously, bring said suction cups closer, each drawing one of said walls of each bag, so that they follow the deformation thereof;

disposing and maintaining the sachets vertical; each bag thus opened is then filled by gravity and/or by any type of doser, with a given liquid, pasty, solid or pulverulent product, and, in a particular modus operandi, different from that of the other bags of the same sachet, in at the most two filling stations disposed along the bag-forming line.

The result is a novel bag-forming device and process for producing sachets of rectangular shape, such that they comprise at least two bags, and preferably three or more of the same height, made in a continuous web of supple material with double walls, sealed and closed, each containing a liquid, pasty or pulverulent product in a given quantity which may be different from that contained in the adjacent bag of the same sachet, in automatic, rapid and reliable manner, whatever the height of said sachets and the respective width of each bag; in fact, in the same sachet, as a function of the products which it is desired to dose, certain of them may be in a larger quantity than others and thus require different bag widths, at least for two of them.

Thanks to the specific device and process of the invention, such sachets may thus be easily obtained, since the inclination of the guides bearing the arms of each suction cup makes it possible, by their convergent orientation, in their mobility of opening of the bags, to bring the suction cups located on the same side closer to one another, and therefore to follow the deformation of the material constituting said walls of the bags; this makes it possible to open them simul-taneously to the maximum of their opening, whether it be near the latter or towards the bottom of each bag by the arrangement of a double suction cup device and to obtain an open and preformed capacity whose volume predetermined to that end may then receive a product, even by simple gravity, without requiring injection forcing the deformation of the walls and/or overdimensioning of the bag so that it accepts the quantity of product which it is desired to pack therein.

Such a device and process may be used in any type of heretofore known bag-forming lines, such as those shown in the accompanying Figures, with, of course, adaptation at the level of the automatisms and positions of the different sachets and the different bags with respect to the products which it is desired to fill therein.

Other advantages of the present invention might be mentioned, but those set forth above already show sufficient to prove the novelty and interest thereof, The following description and the accompanying Figures show an embodiment of the invention, but without any limiting character. Other embodiments are possible within the framework of the scope and extent of this invention, in particular by changing the an arrangement of the bag-forming line and the various mechanisms controlling spacing apart of the suction cups, and, of course, the number of bags per sachet, which may be 2 or 4 or even more, even if this would complicate the drive mechanisms which are not shown here since they are already known and are not concerned by the present invention.

DESCRIPTION OF PREFERRED EMBODIMENT

Figure 1:
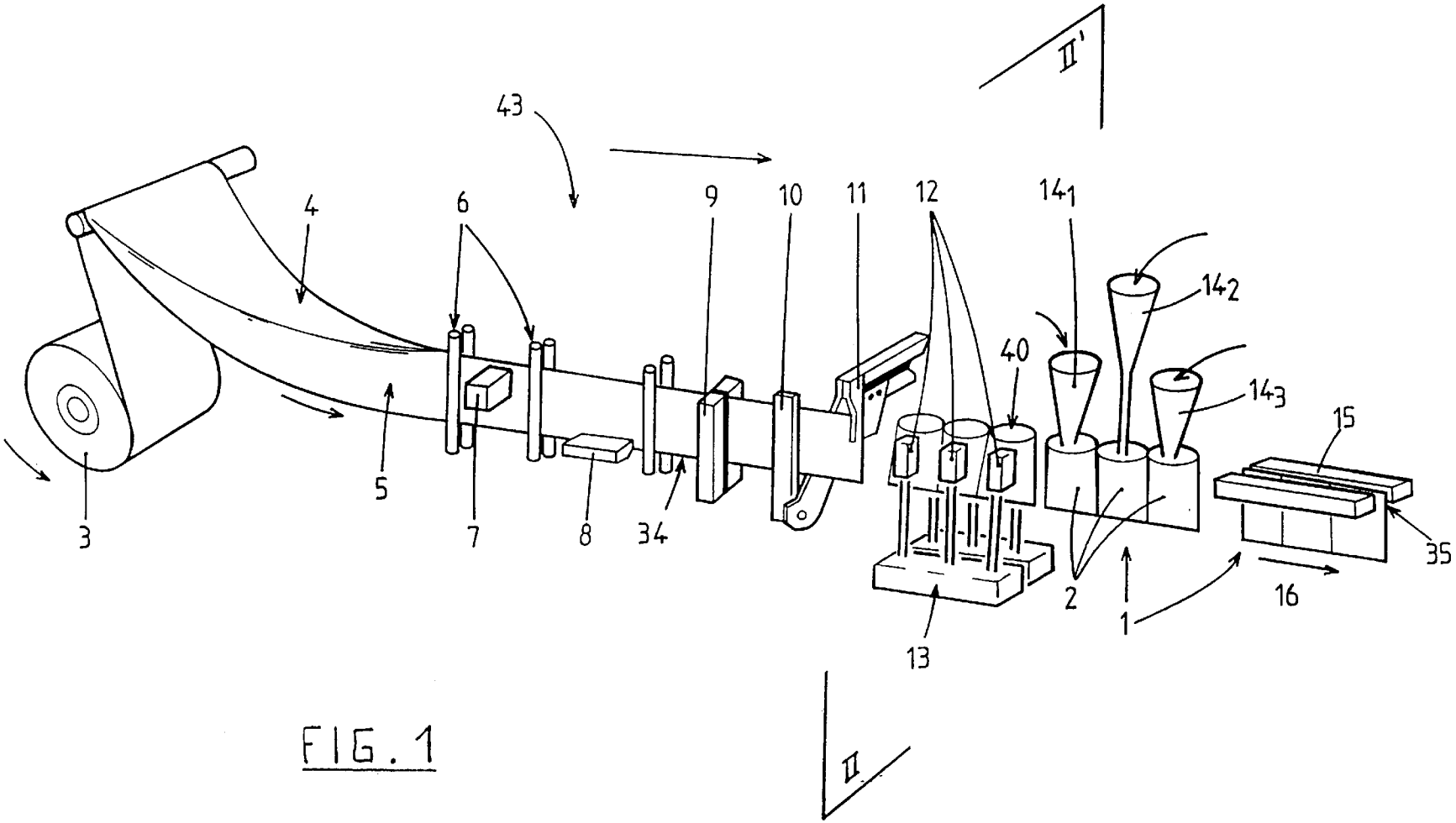
FIG. 1 is a schematic overall view of an example of a bag-forming line employing the process of the present invention.

Referring now to the drawings, according to FIG. 1 and in known manner, the bag-forming process in accordance with the invention is carried out in a bag-forming line 43 disposed in a horizontal axis of advance, such that:

there is disposed on a reel 3, whose axis may be horizontal, a sheet of constant and continuous width, of a supple and deformable material but presenting a certain rigidity and resistance in order not to tear and adapted to be manipulated without risk of being pierced, and, depending on the case, presenting properties of heat-sealing, as well as of tightness in order to be able, on the one hand, not to tear easily if it is wet and, on the other hand, to contain products such as liquids; such a sheet may be produced with metal alloy films, such as of aluminium, on the outer face of which information concerning the product, its mode of use, its composition, the Trademark, etc. may be pre-printed with identification codes in order to be able to control all of the devices of said assembly line; to that end for example, a photocell 7 is disposed at the head of the line, before the work stations described hereinafter, which reads said codes which may be bar codes and thus remotely control the speed of step-by-step advance of the line 43 as well as the different operations as described hereinafter, so that they are each made at the desired spot on the web 5;

said sheet unwound from the reel 3 is formed by folding 4 to constitute said web 5 of constant width with double walls fast with each other by one of their continuous edges 34 which is here that of the fold; in order to obtain such a double-wall web, two sheets coming from two reels and opposite each other may also be welded along this continuous edge 34;

said double-wall web 5 is passed between lateral guides 6 which may be vertical in order to centre it and present it in the axis of each subsequent work station; the step-by-step advance of said web through said stations, at a predetermined rhythm defined thanks to the code reading by the photocell 7 as a function of the web in question, is ensured by one or more grippers or other traction devices 11 which grip and displace said web 5 to cause it to advance step-by-step through the bag-forming line 43; in FIG. 1, only one gripper is shown, but it is certain that, once the web 5 has been cut into several sachets, as defined hereinafter, there must be several grippers in order to maintain and bring each sachet into the different subsequent work stations concerned;

even if the web 5 is obtained by folding one single sheet, as shown in FIG. 1, it is possible to add, in order to reinforce the lower edge 34, a seal such as by a lower weld 9 of the said two walls against each other, near said lower edge 34, as if it were two walls constituted by two originally indepen-dent sheets;

the two walls of the web 5 are then sealed together (9) by welding, heat-sealing, adhesion or other process, perpendicularly to said continuous lower edge 34, over a zone 41 of sufficient width to be divided into two, while keeping the walls sealed, at predetermined given intervals to produce bags 2, whose bottom is then constituted by said continuous edge 34 of the web 5;

said web is cut (10) along and in the middle of certain of said seals 9 defining bags, to obtain sachets 1 independent of one another and composed of at least two tags and here of three, maintained fast; in accordance with FIG. 1, said cuts 10 therefore take place every three seals;

on one of said cutout or sealing stations, or on a specific station, a pre-cutout line 42 may also be created, employing piercing in particular, for example in the middle of said zones 41 of seal to allow, subsequently, a separation of the bags 2 from one another for the same sachet 1;

the free edges of the fourth side of each bag located on the side opposite said bottom 34 thereof are then opened (40) by at least as many pairs of suction cups 12 located on either side of said web as there are bags constituting each independent sachet, which suction cups 12 draw each of said walls, so that they follow the deformation thereof thanks to the process and particular device described hereinafter; according to the present invention, the number of bags of each sachet is at least equal to two and preferably three, as shown in the different accompanying Figures.

all of said sachets 1 being disposed vertically either from the beginning of the bag-forming line 43 or in the course of it, they are maintained vertically, the opening oriented upwardly, the bags 2 being open thanks to the preceding device and described in greater detail hereinafter, in order to fill them (14) by gravity and/or by any doser device, with a given product 14, liquid or pulverulent or pasty, in one station or possibly in two if the dimensions of the filling devices do not enable them to be placed at one spot in one station of the bag-forming line; the bags being perfectly open thanks to the device of the invention, there may be disposed thereinside the exact desired dose of the products $\mathbf{14}_1$, $\mathbf{14}_2$, $\mathbf{14}_3$ without risk of overflow, the dimensions of each bag being predetermined in order to be able to contain said dose;

said edges 35 of the opening are then sealed (15) in order to close each bag 2 and then evacuate (16) all the sachets 1 comprising said three bags 2 of the example shown, each filled, depending on the case, with a different product $\mathbf{14}_1$, $\mathbf{14}_2$, $\mathbf{14}_3$.

To ensure simultaneous opening 40 of the three bags of each sachet 1 and guarantee a volume in each of the bags for receiving the desired dose 14 of product which it is desired to fill therein, which must be able to be deposited by gravity without being able the deform the walls of said bags itself, at least as many pairs of suction cups 12 are disposed (13) on either side of said web 5 as there are bags 2 constituting each independent sachet; said suction cups 12 are mounted at the end of arms 32 mobile with respect to fixed guides 21 and forming a divergent angle therebetween, of which the aperture $\alpha$ is oriented opposite the plane defined by said web 5, so that each suction cup 12 may be placed against each wall of a bag 2 of said sachet and be adapted to draw thereon to open said bags, in particular by a suction device 44 creating a vacuum at the centre of each suction cup; said arms 32 supporting the latter are mounted on guide supports 17 fast with lever supports 20 which, when they are spaced apart in order to open the openings 40 of said bags 2 of the same sachet 1 simultaneously, drive them along the guides 21 and thus bring said suction cups 12 on the same side closer to one another, thus each driving a wall of a bag so that they follow the deformation thereof causing the opening of the bag.

On opening, the bags 2 will in fact cause their lateral sides common with the adjacent bags of the same sachet 1, to come closer to each other; similarly, the suction cups 12, thanks to the device of the invention, following their convergent guide 21, will approach one another. Moreover, if the bags are not of the same width $\mathbf{1}_1$ and if it is then desired to open the widest more, in order to deposit a larger dose of product, the suction cups 12 must be moved apart by a greater distance than the others: this is possible by disposing two lever supports 20 as descried hereinafter, articulated at the end located towards the narrowest bag 2, and giving the suction cups 12 closest to their axis of rotation $Z_1$, $Z'_1$ a displacement of separation less than the most remote ones.

Figure 3:
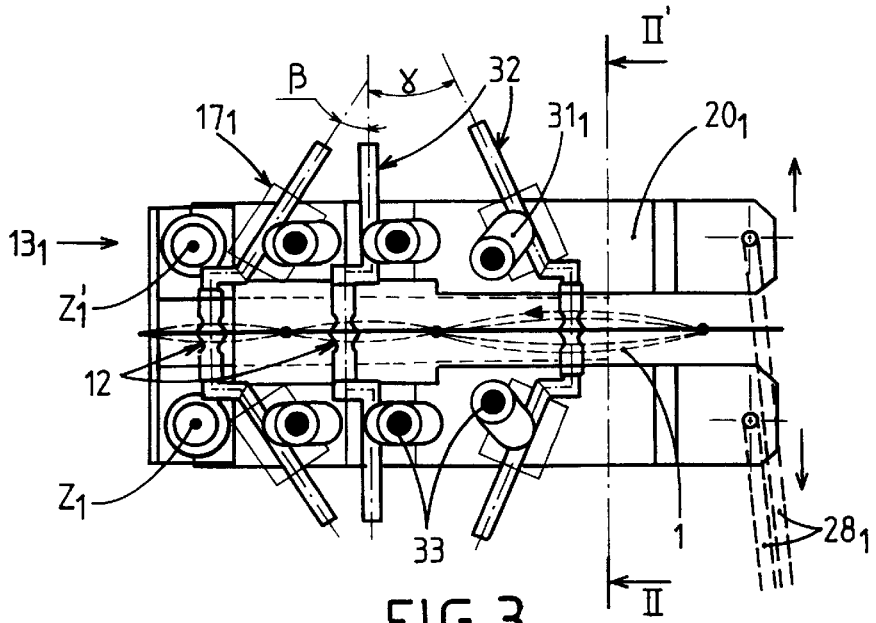
FIG. 3 is a plan view of the upper opening device or head according to FIG. 2.

FIG. 3 shows in solid lines in plan view, in the plane of advance of the sachets 1, along the bag-forming line 43, the closed bags 2 on which the suction cups 12 are applied in order to open their walls, and, in broken lines, an example of position during opening of said walls for three bags of gradually greater width which are moved away from the axes of rotation $Z_1$, $Z'_1$.

Figure 2:
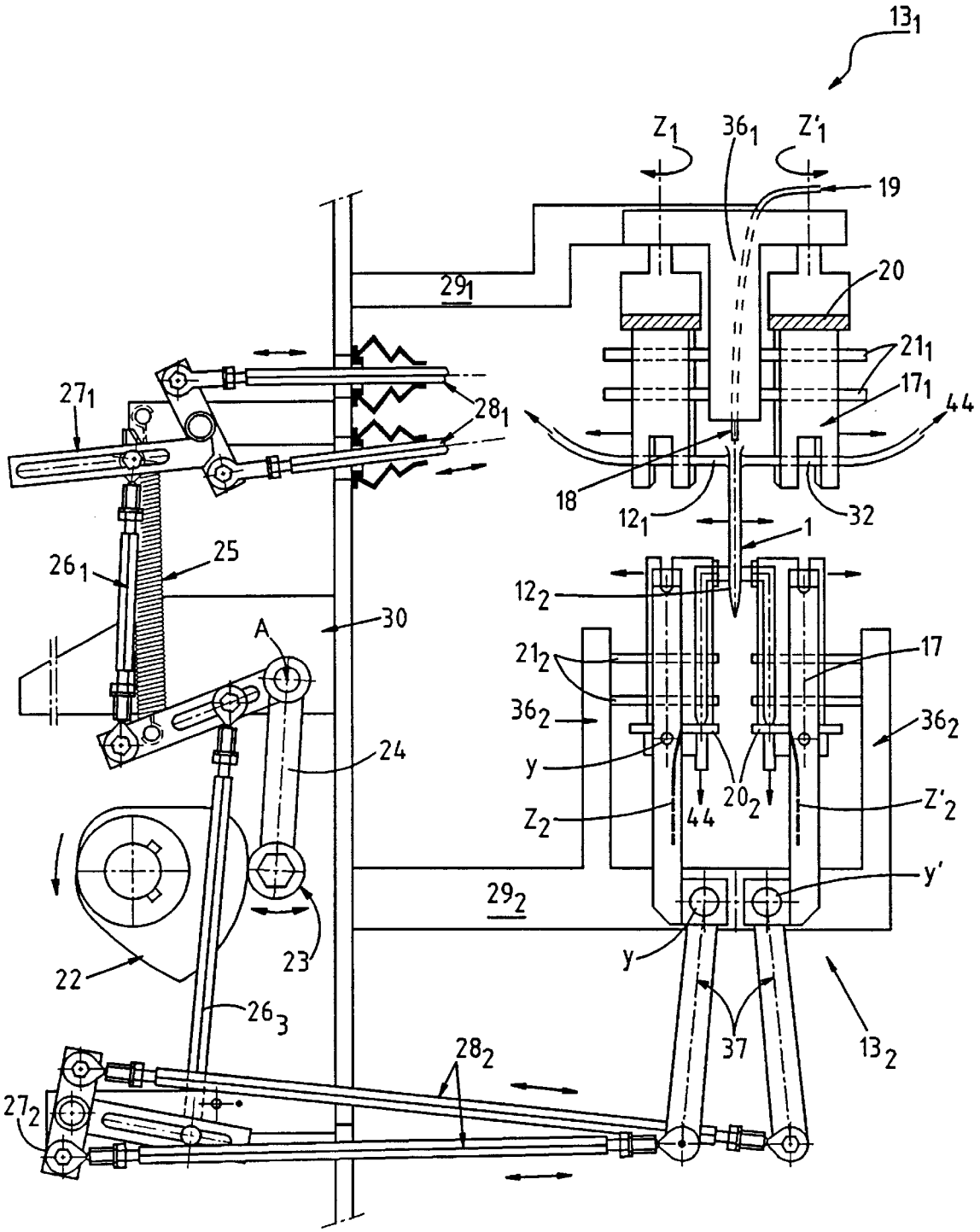
FIG. 2 is a view in section along II–II' of the opening device shown schematically in FIG. 1.

Such devices are shown in FIG. 2 in transverse view along plane II–II' of FIG. 1.

When the height of the sachet bags 2 is great, for example in order to receive large doses of products 14, in order to be sure of opening all the volume of the bags to that end, two pairs of suction cups 12 per bag 2 are arranged, the second, lower ones $\mathbf{12}_2$ being located between the bottom 34 of said bags and the upper ones $\mathbf{12}_1$ ensuring opening 40 of said bag; these two assemblies of pairs of suction cups 12 are each preferably borne in a distinct device or head, one $\mathbf{13}_1$ located in the upper part above the bags and the other $\mathbf{13}_2$ located in the lower part therebeneath. The mechanisms for opening and displacing the suction cups being produced in accordance with the same technical principle as described hereinafter: a fixed support unit 36 is fast with the assembly of the frame 30 of the machine of the bag-forming line 43 and bears fixed guides 21, preferably two per suction cup to ensure maintenance in a plane and located one above the other in a plane parallel to the desired displacement thereof and at angles $\alpha$, $\beta$ open towards said sachet 1 and as defined hereinbefore: for three bags 2 and therefore three pairs of arms 32, said angles $\alpha$, $\beta$ formed by the latter and therefore their guides 21, shown in FIG. 3, are determined as a function of the width 1 of each bag 2 and therefore of their deformation when they are opened, determining the necessary value of approach of the suction cups.

From said fixed support unit 36, the two lever supports 20 are articulated either directly, for the upper head $\mathbf{13}_1$ about axes $Z_1$, $Z'_1$, or indirectly by two lever arms 37 driving connecting pieces 38 of axis Y connected to said lever supports 20 which then pivot and move apart, each along an axis $Z_1$, $Z'_1$, for the lower head $\mathbf{13}_2$.

Said articulated lever supports 20 drive said supports 17 of the suction cup arms 32 thanks to rollers 33 adapted to move in windows $\mathbf{31}_1$ made in said lever supports 20, in the desired direction to follow both the spacing apart and convergence of the suction cups 32; to that end, the guide supports 17 of the suction cup arms slide on said fixed guides 21 which impose thereon the angle and orientation of displacement, levers 20 ensuring the amplitude of said displace-ment.

Other forms of embodiment are possible to obtain the same function of aperture $\alpha$ of the suction cups 12, such as the one, not shown, wherein the lever supports 20 drive the end of the arms 32 of suction cups, which are then fixed thereto and articulated without slide nor need for windows $\mathbf{31}_1$; the fixed guides 21 are, for their part, made by long, open windows or notches in a fixed plate, having the same desired directions as hereinabove to obtain the angles $\alpha$ and in which slide fingers equipped with fixed rollers towards the other end of the suction cup arms 32.

In order to be able to adapt the distances of the arms 32 with respect to one another and the amplitude of their movement and their angle, either different devices or heads $\mathbf{13}_1$, 13, may be made for each type of sachet, or a minimum of adjustment may be provided of the position of said suction cups 12 with respect to their support $\mathbf{17}_2$ such as via windows 39 made in said supports 17 in which said nozzle supports $\mathbf{12}_2$ are blocked by any meals of fixation, or the ends of arms 32 of the nozzles may be changed and adapted as for upper assembly $\mathbf{13}_1$, which arms, as in FIG. 3, are bayonet form and whose part parallel to the plane defined by the assembly of the nozzles 12 which is also that of the walls of the web 5 before deformation, are more or less long to that end.

Figure 4:
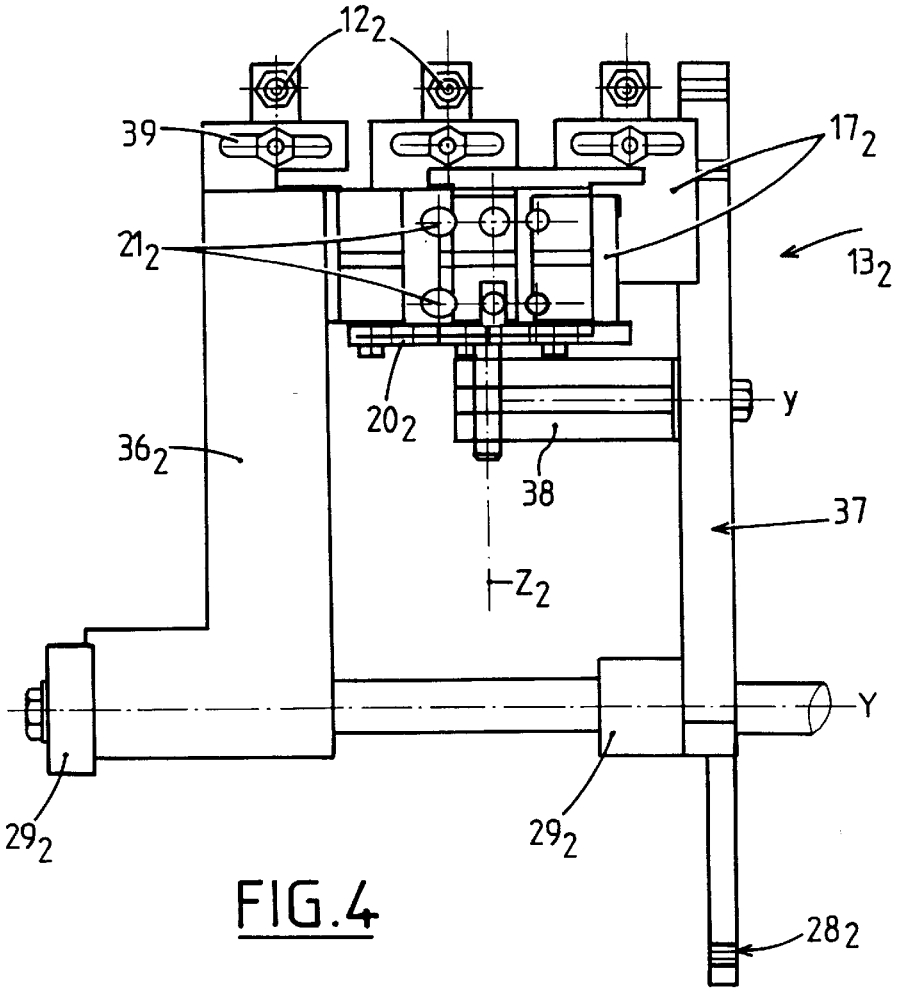
FIG. 4 is a side view of the lower opening device or head of FIG. 2.

To allow simultaneous opening of said levers 20 driving said suction cups 12 exactly at the desired moment during passage, the presentation and stop of a sachet 1 with respect to one another, control rods 28 are connected to the end of said levers 20, either directly in the case of the example of the upper head $\mathbf{13}_1$ or indirectly by the assembly of arms and connecting pieces 37, 38 in the case of the lower head $\mathbf{13}_2$ of FIG. 4; which control rods 28 are for example, according to FIG. 2, driven by secondary control levers 27 whose displacement is ensured by connecting rods 26 whose reciprocating movement is controlled by a principal control lever 24, articulated at one of its ends around an axis A: at its other end, this control lever 24 bears a roller bearing 23 maintained in contact by a spring 25 against a cam 22 driven in rotation at the desired speed; such a drive device is perfectly well known in different existing bag-forming lines and simultaneously also performs the functions of all the other work stations, such as those shown in FIG. 1, from the same control shaft incorporating cams 22.

On the upper head $\mathbf{13}_1$, in order to assist separation of the walls sucked by the suction cups $\mathbf{12}_1$, preferably as many nozzles 18 as there are bags 2 are provided to blow a gas such as air 19 which, apart from assisting opening 40, also allows inflation of the whole of the bag and completes the work of the lower suction cups $\mathbf{12}_2$.

Figure 5:
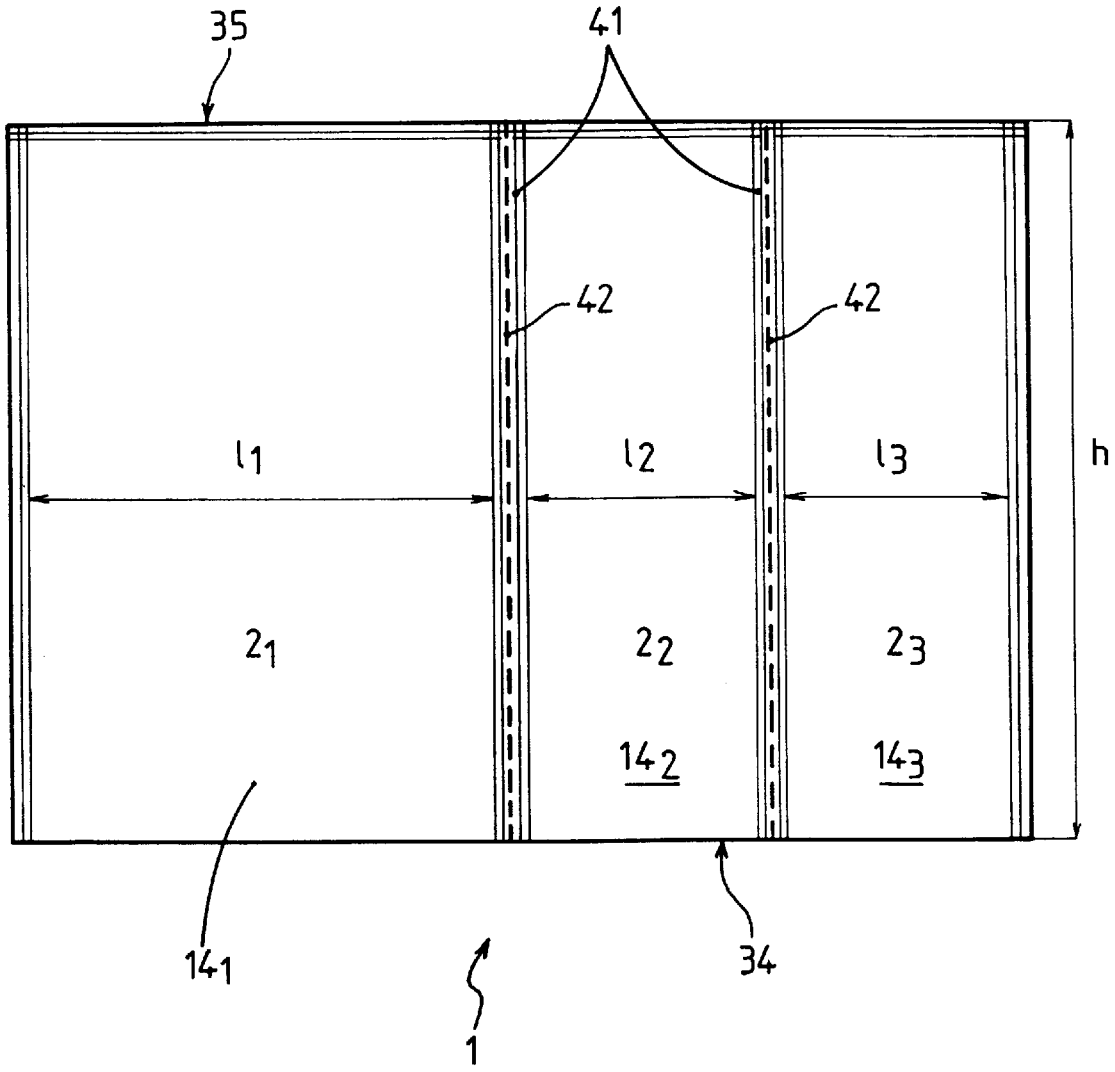
FIG. 5 is a side view of a sachet with 3 bags, according to the invention.

Once said bags are opened then filled (14) and sealed (15) in their upper part 35, a sachet 1 of rectangular shape is obtained, as shown in FIG. 5, comprising at least two sealed bags 2 or three as shown, made in the same continuous web 5 of supple double-wall material, sealed and closed and each containing a given quantity of product 14 which may be different from that contained in the adjacent bag of the same sachet 1; according to FIG. 5, said sachet thus comprises three bags 2 of the same height h, of which at least two, $\mathbf{2}_1$ and $\mathbf{2}_2$, are of different width $\mathbf{1}_1$, $\mathbf{1}_2$, or $\mathbf{1}_1 > \mathbf{1}_2$ in order to receive in the bag $\mathbf{2}_1$ a product 14 in a quantity greater than that $\mathbf{14}_2$ of the bag $\mathbf{2}_2$.

Each bag 2 is connected to the adjacent one by a zone 41 of seal, preferably comprising a pre-cutout line 42. Such sachets thus produced and shown in FIG. 5 are novel and unknown to this day prior to the present invention.

What is claimed is:

1. Process for forming sachets having multiple bags, filled with product, said method comprising:

forming a web of constant and continuous height, made of a supple material with two opposite walls secured to each other at one of the continuous longitudinal edges thereof;

sealing said walls together, perpendicularly to said one of the edges, at given intervals to produce seals defining successive bags whose bottoms are constituted by said one of said continuous edges of the web;

cutting said web along said seals to obtain sachets independent of one another wherein each sachet includes at least two bags;

opening free edges of each bag of each sachet located opposite the respective bottom thereof by two suction cups each engaging a respective wall of each bag and moving said wall away from the wall opposite thereto while maintaining said walls vertically;

filling each bag, thus opened, with a product, and sealing said free edges of the open bag to close and seal each bag, arranging said suction cups so that for each wall of each bag to be opened a respective suction cup is provided, simultaneously displacing the suction cups on the opposite walls of the bags away from one another to open the bags of each sachet simultaneously, and moving the suction cups on each wall of the bags towards one another longitudinally while the suction cups engaging the opposite walls of the bags are being displaced away from one another to allow the suction cups to displace with the walls of the bags as said bags are being opened in order to avoid deformation of the material of said bags.

2. A sachet of rectangular shape constituted in accordance with the process of claim 1, which comprises at least two bags made from the two walls of the same continuous web of the supple material, sealed and closed, and each containing product in a given quantity which may be different from that contained in the adjacent bag of the same sachet.

3. The sachet of claim 2, which comprises at least three bags of the same height of which at least two bags are of different width.

4. The sachet of claim 2, wherein the seal connecting each bag to the adjacent bag comprises a pre-cutout line.

5. A process as claimed in claim 1, comprising mounting said suction cups on each side of the bags on arms movable with respect to fixed guides, forming an angle between said arms associated with adjacent bags, said angle diverging in the direction of said bags, attaching said arms to supports which are displaced away from the web when opening the bags and guiding said arms as said arms are moved by said supports to open said bags such that said suction cups on said arms simultaneously move towards one another.

6. A process as claimed in claim 5, wherein said web is cut after at least every third bag to form each said sachet with three bags each bag being filled with a product different from the other bags in no more than two filling stations disposed along a bag-forming line.

7. A process as claimed in claim 6, wherein a second suction cup is provided for each bag at a location between the free edge of the bag and the bottom thereof.

8. A process as claimed in claim 1, wherein each sachet is formed with three bags including a central bag, and two end bags, and arranging said arms on which the suction cups are mounted so that the arms for the end bags form said angle with the arms for the central bags such that the suction cups which open the central bag move away from one another without displacement longitudinally while said suction cups which open the end bags move longitudinally towards the cups which open the central bag.

9. Device for opening a sachet of rectangular shape formed by two walls of supple material fast on three sides and forming at least two adjacent bags arranged longitudinally along the sachet, said device comprising two suction cups disposed opposite each other so that said suction cups can be placed against each wall of said sachet and open the walls at the level of a fourth side not fast with said bag, at least two pairs of said suction cups being mounted at the ends of arms which are movable to cause the suction cups to open the walls of the bags, fixed guides for said arms, and means for displacing said arms to cause said suction cups to open said walls of the adjacent bags simultaneously, said arms which are associated with the same wall of adjacent bags forming an angle therebetween which diverges in a direction towards said bags, said guides being arranged to guide said arms so that said suction cups move longitudinally towards one another as said bags are being opened so that said suction cups follow movement of the walls of the bags and avoid deformation of the material of said bags.

10. The device of claim 9, further comprising at least two gas-blowing nozzles oriented in a plane defined by said suction cups.

11. The device of claim 9, wherein two assemblies of pairs of said suction cups are disposed on opposite sides of said bags, each pair being associated with a respective bag.

* * * * *